United States Patent [19]

Dacal

[11] 4,042,819

[45] Aug. 16, 1977

[54] FLUORESCENT LAMP FOR USE IN EXPLOSIVE ATMOSPHERES SUCH AS MINES

[75] Inventor: Perfecto Dacal, Beckley, W. Va.

[73] Assignee: Control Products Inc., Beckley, W. Va.

[21] Appl. No.: 704,061

[22] Filed: July 9, 1976

[51] Int. Cl.[2] ..... H05B 33/02

[52] U.S. Cl. ..... 240/51.11 R; 240/102 R

[58] Field of Search ..... 240/51.11 R, 46.01, 240/92, 102 R, 11.3, 11.4 R

[56] References Cited

U.S. PATENT DOCUMENTS

| | | | |
|---|---|---|---|
| 3,136,489 | 6/1964 | Oharenko | 240/51.11 R X |
| 3,805,053 | 4/1974 | Julinot | 240/51.11 R |
| 3,808,495 | 4/1974 | Win | 240/92 X |

FOREIGN PATENT DOCUMENTS

| | | | |
|---|---|---|---|
| 1,126,509 | 4/1961 | Germany | 240/51.11 R |

*Primary Examiner*—Richard A. Wintercorn

*Attorney, Agent, or Firm*—McCaleb, Lucas & Brugman

[57] ABSTRACT

Lamp having a lighting assembly, an inner guard assembly, and an outer guard assembly. The lighting assembly includes an elongated fluorescent bulb, starter and ballast members each having a socket portion removably connected to pins at the ends of the bulb, and an electrically conductive grounding bar interconnecting the starter and ballast members. The inner guard assembly includes a transparent cylindrical plastic housing enclosing the bulb, and end housings at the ends of the cylindrical housing enclosing the starter and ballast members respectively. The outer guard assembly includes an elongated support plate to which the end housings are fastened, a plurality of hoops fastened to the support plate at spaced intervals, and a plurality of guard rods parallel to the bulb housing welded across the hoops to provide a cage-like outer protection for the inner guard assembly. The ballast member is unitary, including one of the above-mentioned socket portions at one end removably electrically connected to the pins at one end of the bulb, and a plug at the opposite end removably electrically connected to a power outlet socket in the corresponding end housing of the inner guard assembly. The starter member is likewise unitary, including the other of the above-mentioned socket portions as an integral part thereof. The end housing at the starter member end of the lighting assembly has a removable cover for an opening through which the entire lighting assembly can be removed and replaced as a unit. The end housing at the ballast member end of the lighting assembly also has a removable cover providing access to the connection between the ballast member plug and the power outlet socket.

8 Claims, 9 Drawing Figures

Fig 1
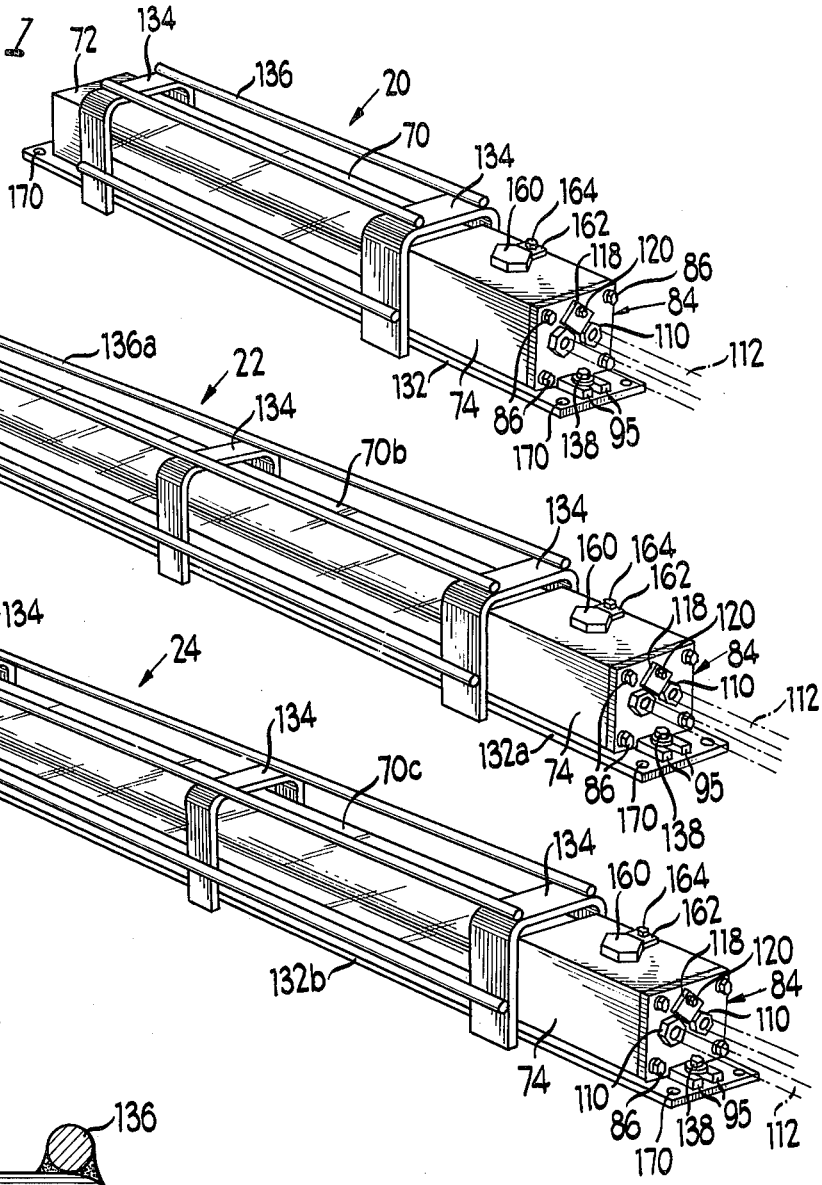
Fig 2
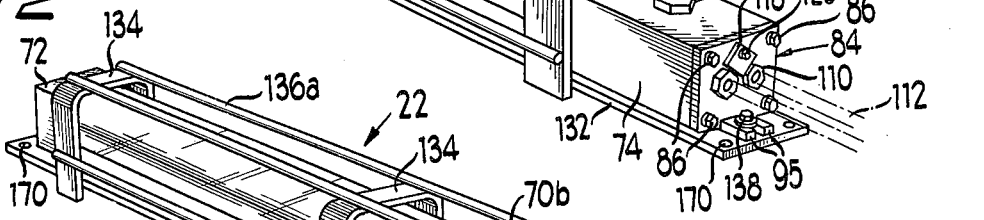
Fig 3
Fig 8
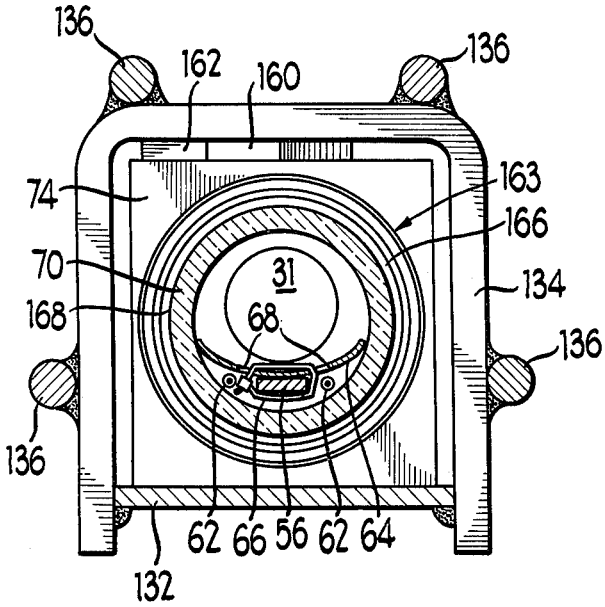

40
31
32
5
5

BALLAST MEMBER
40
STARTER MEMBER
32
31
8
8

FLUORESCENT LAMP FOR USE IN EXPLOSIVE ATMOSPHERES SUCH AS MINES

CROSS REFERENCES TO RELATED APPLICATIONS

Reference is made to the following co-pending applications:

Dacal U.S. Ser. No. 680,048 Filed Apr. 26, 1976, on FLUORESCENT LAMP FOR USE IN EXPLOSIVE ATMOSPHERES SUCH AS MINES.

Dacal U.S. Ser. No. 689,596 Filed May 25, 1976 on FLUORESCENT LAMP FOR USE IN EXPLOSIVE ATMOSPHERES SUCH AS MINES.

BACKGROUND OF THE INVENTION

This invention pertains to the field of electrical illuminating apparatus and particularly to such apparatus which is permissible under Mining Enforcement and Safety Administration (MESA) standards and regulations for use in explosive atmospheres such as coal mines.

Lighting in mines has always been relatively poor compared to working environments above ground where minimum illumination standards for various tasks have long been established.

The difficulty of providing adequate lighting in coal mines is aggravated by the low reflectivity of the black coal or associated minerals in the roof, floor, and side walls. Rock-dusting where employed does provide a reflective white or light gray surface along established haulage ways and heavy traffic areas such as underground maintenance shops, areas immediately adjacent the bottoms of hoisting shafts, and loading points along conveyors. These locations are relatively well-lighted with permanent lighting.

By contrast, rooms where coal is actively being mined are relatively poorly lighted. These rooms have not yet been rock-dusted and the freshly exposed black surfaces provide no practical reflectivity. Illumination is provided only by miners' cap lamps and one or more high intensity headlight-type lamps on each piece of mobile mining machinery. In the case of shuttle cars, which operate in both directions, there will be one or more headlights on each end. Even where such high intensity lamps are directed toward the face, or toward the direction of movement of the machine, lighting is far from uniform. The operator of a continuous mining machine, or loading machine, will have enough light brilliantly illuminating the mine face to keep his machine working efficiently. but the rear boom just behind him is in relative darkness making it difficult for him to see a person immediately behind or to the side. Inasmuch as these face-working machines have conveyor discharge booms which are tiltable up and down, and swingable from side to side, there have been numerous accidents involving persons unseen by the machine operators being struck by the discharge booms and pressed against another machine or one of the side walls.

MESA reports show that almost all serious and fatal accidents in working places occur while self-propelled equipment is operated in them.

Pursuant to authority under the Federal Coal Mine Health and Safety Act of 1969, the Secretary of the Interior has promulgated new illumination standards for underground coal mines which, among other things, specify that the entire area surrounding self-propelled mining equipment for a minimum distance of 5 feet be illuminated with a surface brightness of at least 0.06 footlamberts.

To provide this level of illumination, something more efficient than conventional incandescent lamps must be used. A few attempts have been made to develop fluorescent lighting which is permissible for use in potentially explosive atmospheres such as coal mines, and which could provide the high level of illuminations required by the new standards, but none of these attempts have yet been successful enough to warrant large scale production and use.

SUMMARY OF THE INVENTION

It is a general object of the present invention to provide a lamp which is permissible for use in explosive atmospheres such as coal mines which will provide the high illumination required to meet the MESA standards.

An important feature of the invention is to provide a lamp comprising a lighting assembly having inner and outer guard assemblies. The lighting assembly includes an elongated bulb with starter and ballast members removably connected to opposite ends thereof, and grounding means interconnecting the starter and ballast members. The inner guard assembly includes a transparent cylindrical housing enclosing the bulb, and end housings at the ends of the cylindrical housing enclosing the starter and the ballast members respectively, and electrical power outlet means in one of the end housings electrically connected to the starter and ballast members. And the outer guard assembly includes an elongated support plate having means for mounting the end housings on opposite ends of the support plate, a plurality of hoops fastened to the support place at spaced intervals therealong, and a plurality of rods fastened to the hoops extending parallel to and exteriorly of the bulb housing providing cage-like protection for the inner guard assembly.

Another important feature of the invention is the provision of a cleaner having an annular wiper element engaging the outer surface of the transparent cylindrical housing and slidable along that outer surface to clean it in a single end-to-end movement.

Another object of the invention is to provide a lamp as described in which the grounding means comprises a rigid bar parallel to the bulb and mechanically connected to the starter and ballast members to tie them together into an integral, unitarily removable and replaceable sub-assembly.

Another feature of the invention is to provide a lamp as described having an elongated reflector supported on the grounding bar along the bulb.

Another feature is to provide such a lamp in which the lighting assembly is electrically connected to the electrical power outlet means within one of the end housings through a plug within that end housing, and an access opening in the opposite end housing aligned with the lighting assembly enabling the entire lighting assembly to be inserted into or removed from the inner guard assembly as a unit.

Another feature is to provide a side access opening in the end housing containing the electrical power outlet means to facilitate electrical connections and disconnections between that power outlet means and the plug portion of the lighting assembly.

Another feature is to provide a lamp as described in which the lighting assembly is a readily replaceable unit consisting of a bulb having readily replaceable unitary starter and ballast members at the opposite ends thereof which are individually replaceable on the bulb.

BRIEF DESCRIPTION OF THE DRAWINGS

Other objects and advantages will be apparent from the following description taken in connection with the drawings in which:

FIG. 1 is a perspective view of a fluorescent lamp illustrating one version of a preferred embodiment of a lamp made in accordance with the present invention;

FIGS. 2 and 3 are perspective views similar to FIG. 1 showing different versions of the invention applied to longer, higher wattage lamps.

FIG. 8 is a vertical, transverse cross-sectional view taken along line 8—8 of FIG. 5.

Like parts are designated by like reference characters throughout the drawings.

DESCRIPTION OF THE PREFERRED EMBODIMENT

Although three different lamps 20, 22 and 24 are shown in FIGS. 1, 2 and 3 respectively, they are simply different wattage versions, in different lengths, of the same preferred embodiment of the invention. Lamp 20 by way of example, will be described in detail. As this description proceeds, it will be apparent that the cross-sections and internal parts will be the same in all three versions except that FIGS. 2 and 3 are longer.

Lamp 20 is uniquely applicable for use in underground coal mines under the new illuminating standards described for the following reasons. First, it is permissible under MESA standards for use in explosive atmospheres where methane concentrations in the 5%–15% range are easily exploded by a spark. Second, it will withstand a great deal of physical abuse such as impact from equipment, and even moderate roof falls, without failure or causing an explosion. And third, it is readily serviced on site because the entire lighting assembly including the bulb, starter, and ballast can be removed through a readily opened cover and replaced as a unit.

Figure 9:
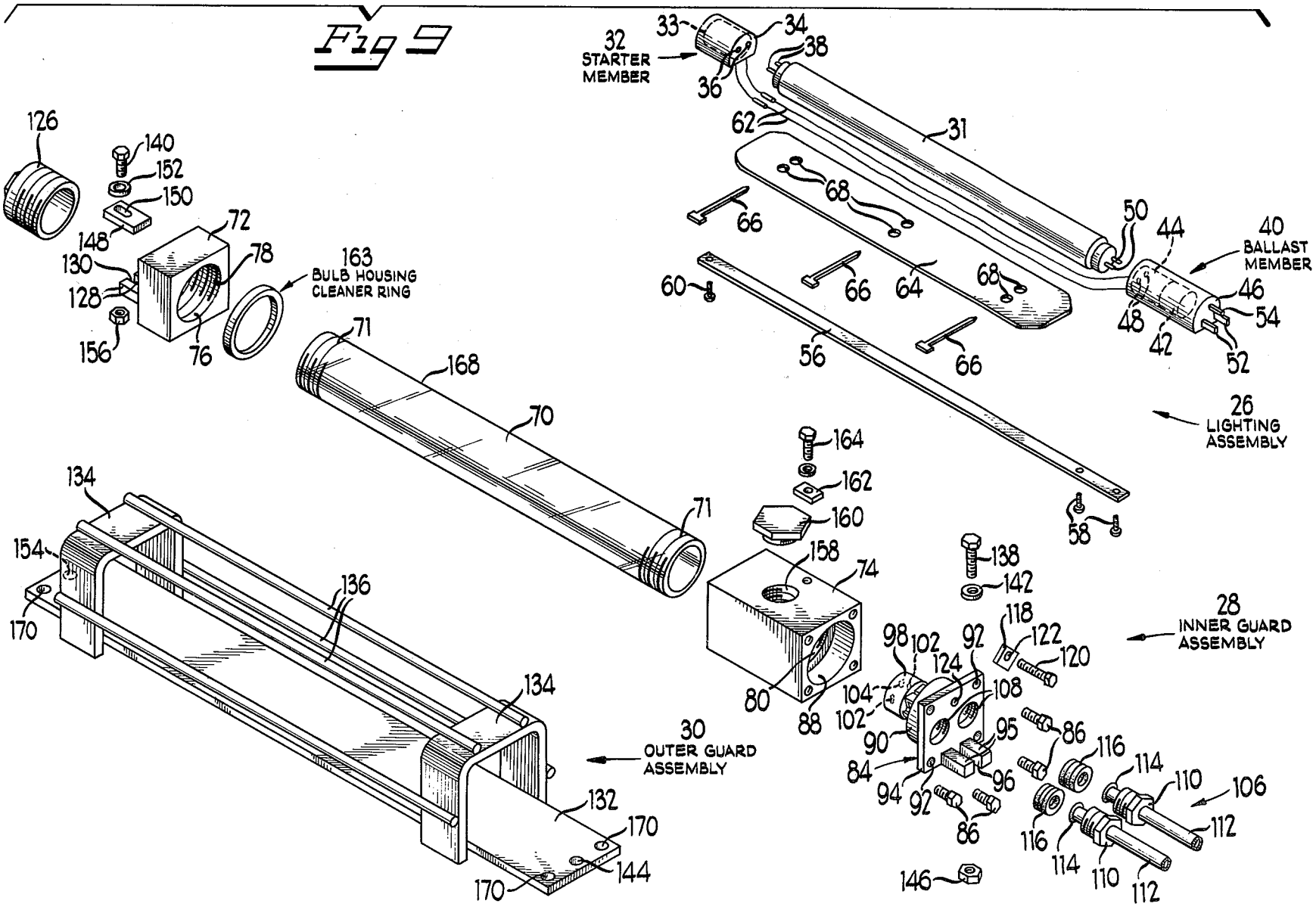
FIG. 9 is an exploded perspective view of the parts of the lamp shown in FIG. 1.

As shown in the exploded view of FIG. 9, lamp 20 comprises a lighting assembly 26, an inner guard assembly 28, and an outer guard assembly 30.

The lighting assembly 26 includes an elongated bulb 31. One of the advantages of this invention is that this may be a standard fluorescent bulb. A starter member 32 comprises a usual starter element 33 and socket means 34 including socket contacts 36, 36 connectible to the pin contacts 38, 38 at the adjacent end of the bulb. The starter element and socket means 34 are potted in epoxy plastic or the like to provide an integral, replaceable unit. A ballast member 40 comprises a usual ballast element 42, and socket means 44 and 3-pin plug means 46 at opposite ends. The socket means 44 has socket contacts 48, 48 connectible to the pin contacts 50, 50 at the adjacent end of the bulb. The plug member 46 has the usual pair of live pins 52, 52 and grounding pin 54 connectible into an electrical power outlet socket 98 to be described. As described above in connection with the starter member, the elements 42, 44 and 46 of the ballast member are potted to provide an integral replaceable unit.

The lighting assembly 26 includes a grounding bar 56 which provides both electrical and mechanical functions. In the first place, it is electrically connected within the ballast member 40 through one of the screws 58, 58 to the grounding pin 54. The other end of the grounding bar is connected by screw 60 to the starter member 32, thereby mechanically interconnecting the starter and ballast members and holding them firmly connected to the ends of the bulb. The power input pins or blades 52, 52 of plug 46 are connected to the starter element 33 through conductors 62, 62 which run along the grounding bar 56. A further function of the latter is to support a reflector strip 64. This is illustrated as a strip of white or otherwise reflective plastic material. As shown in FIG. 8, it is mounted on the grounding bar by plastic tie straps 66, laced through pairs of openings 68 in the strip. This strip is resilient and deflectible and is retained in a curved configuration, as shown in FIG. 8, by constraint imposed by the transparent plastic inner bulb housing, part of the inner guard assembly, now to be described.

Figure 4:
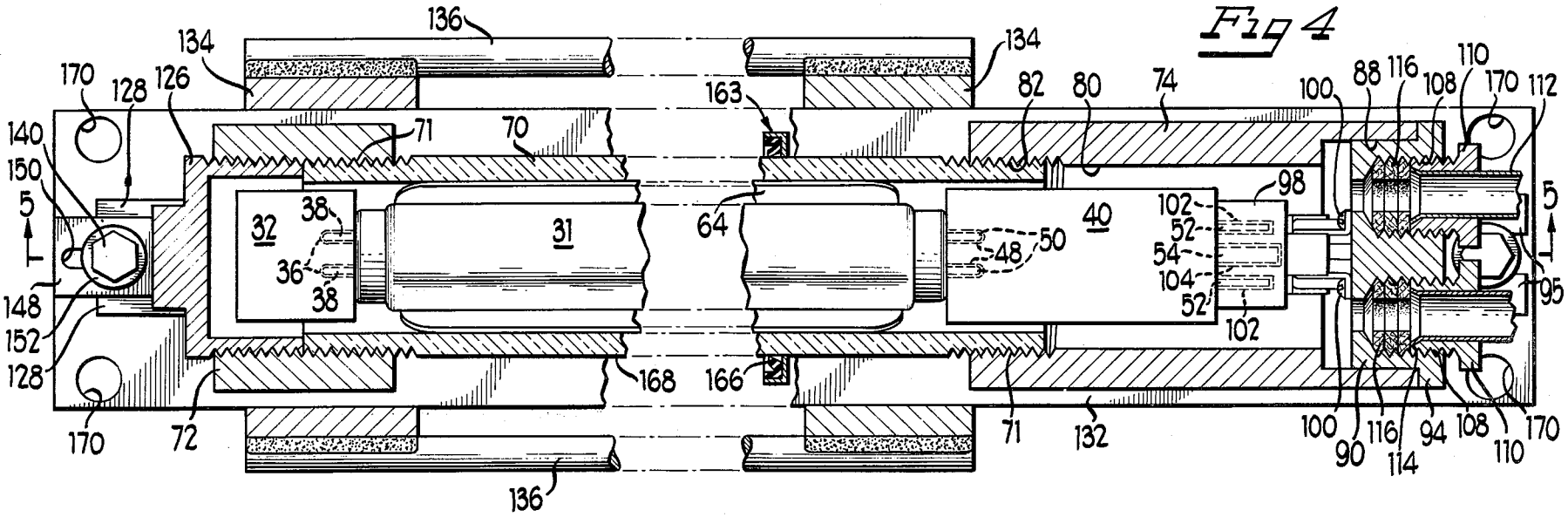
FIG. 4 is a longitudinal, horizontal cross-sectional view of the lamp shown in FIG. 1.
Figure 5:
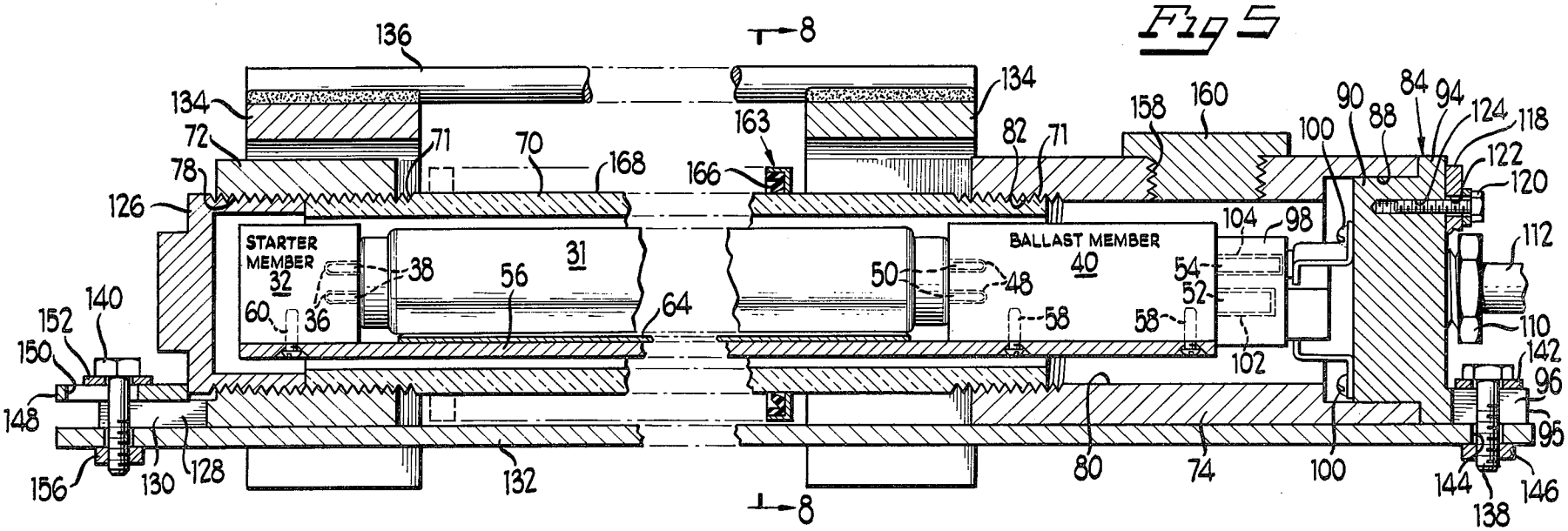
FIG. 5 is a horizontal, vertical cross-sectional view of FIG. 4, taken along line 5—5.

The inner guard assembly 28 includes a transparent, cylindrical, inner bulb housing 70 with external threads 71 at the ends. Among the requirements for this material, it should have very high impact strength and be able to withstand heavy blows; it should have water clear transparency, high dimensional stability over a wide temperature range, good electrical properties, and be self-extinguishing. One of the best materials for this purpose is polycarbonate. In the United States, base resins for polycarbonate plastics are produced by General Electric Company under the trademark "Lexan" and by Mobay Chemical Co. under the trademark "Marlon". As shown in FIGS. 4 and 5, the transparent cylindrical housing 70 encloses the bulb 31.

At the ends of the cylindrical housing are starter and ballast housings 72 and 74 enclosing the starter and ballast members 32 and 40 respectively. Both housings are of metal such as aluminum and have generally square external cross- sections. Starter housing 72 has a through-bore 76 with internal threads 78 engaging the threads 71 at the adjacent end of the transparent cylindrical housing 70.

Ballast housing 74 comprises a hollow body section with a cavity 80 for the ballast member 40. At the left hand end of ballast housing 74 in FIGS. 4 and 5, internal threads 82 engage the threads 71 at the adjacent end of the cylindrical bulb housing 70. At the right hand end of ballast housing 74 in FIGS. 4 and 5, there is a cover section 84 which closes the outer end of the body section, the cover section being fastened to the square flange 94 of the body section by means of four cap screws 86 at the corners (FIG. 9). The body section or ballast housing 74 has a counter-bore 88 within which is closely fitted a cylindrical inner end portion 90 of the cover section 84. The cover section 84 has a pair of longitudinally extending ears 95 defining a mounting-bolt-receiving slot 96 therebetween. Electrical power outlet means, in this case a socket 98, is mounted as by means of screws 100 to the inner face of the cover section 84. The socket 98 has three socket contacts 102, 102 and 104, within which the three pins 52, 52 and 54 of ballast member 40 are connectible.

The central wall of cover section 84 is provided with gland means generally designated 106 through which power conductors (not shown) may be connected into the socket 98. As shown in FIG. 9, the gland means comprises a pair of screw threaded openings 108, 108 in the cover section 84, hexagonal-head gland bushings 110, 110 through which conduit sections 112, 112 are longitudinally slideable. Each conduit section has a flared inner end 114. When the glands are tightened, the flared ends 114 compress packing 116 onto power conductors (not shown) which pass through the conduits and are connected to the socket 98. A safety lock is provided to hold the gland bushings 110 against loosening. In the present case this comprises a square locking tab 118 held by a cap screw 120 against the outer surface of the cover section 84 and positioned to interfere with rotation of both gland bushings. The screw hole 122 in the tab 118 may be provided slightly off center as shown, for adjustment purposes. The cap screw 120 is engaged with the tapped bolt hole 124 in the cover section 84.

In the embodiment shown, the internally threaded through-bore 76 of the starter housing 72 extends all the way through to the outer end where it is closed by an externally threaded inspection cover or cap 126. A pair of ears 128, 128, similar to ears 94 are provided on the outer end of the starter housing. They define a receiving slot 130 for a mounting bolt to be described.

The outer guard assembly 30 includes an elongated support plate 132, a plurality of inverted U-shaped hoops 134 fastened as by welding to it, and a plurality of rods 136 fastened to the hoops, also by welding, extending parallel to and exteriorly of the inner bulb housing 70 to provide cage-like protection for it.

Referring to FIGS. 5 and 9, means is provided for mounting the end housings 72 and 74 of the inner guard assembly onto the ends of the support plate 132. This includes the mounting bolts 138 and 140, and associated parts which will now be described. At the ballast housing end of the lamp, the bolt 138 and washer 142 are mounted on ears 95 and extends through slot 96 between the ears, and botl hole 144 in the mounting plate. A nut 146 beneath the mounting plate holds the bolt firmly in place when tightened.

A locking tab 148 comprising a substantially square plate with a slot 150 is retained by washer 152 and bolt 140 which extends through the slot 130 between ears 128 and bolt hole 154 in the support plate. This is retained by nut 156 under the plate. Thus, bolt 140 serves two purposes: it supports the locking tab 148 in engagement with the inspection cover 126 to prevent the latter from being inadvertently loosened; and it supports the starter member housing 72 on the plate 132.

To compensate for slightly different longitudinal variations in the extent to which the threaded parts are screwed together, and compensate for manufacturing variations, the slots 96 and 130 enable the parts to be shifted on the support plate 132; and the slot 150 and tab 148 enables the latter to hold the inspection cover 126 in place against inadvertent loosening in spite of variations in the depth to which the cover 126 is screwed into the starter housing 72. The support plate 132 may be suitably mounted on a bracket at a stationary location in a mine, or on a mobile mining machine, using for example, the holes 170 in the support plate 132 as bolt holes.

Figure 6:
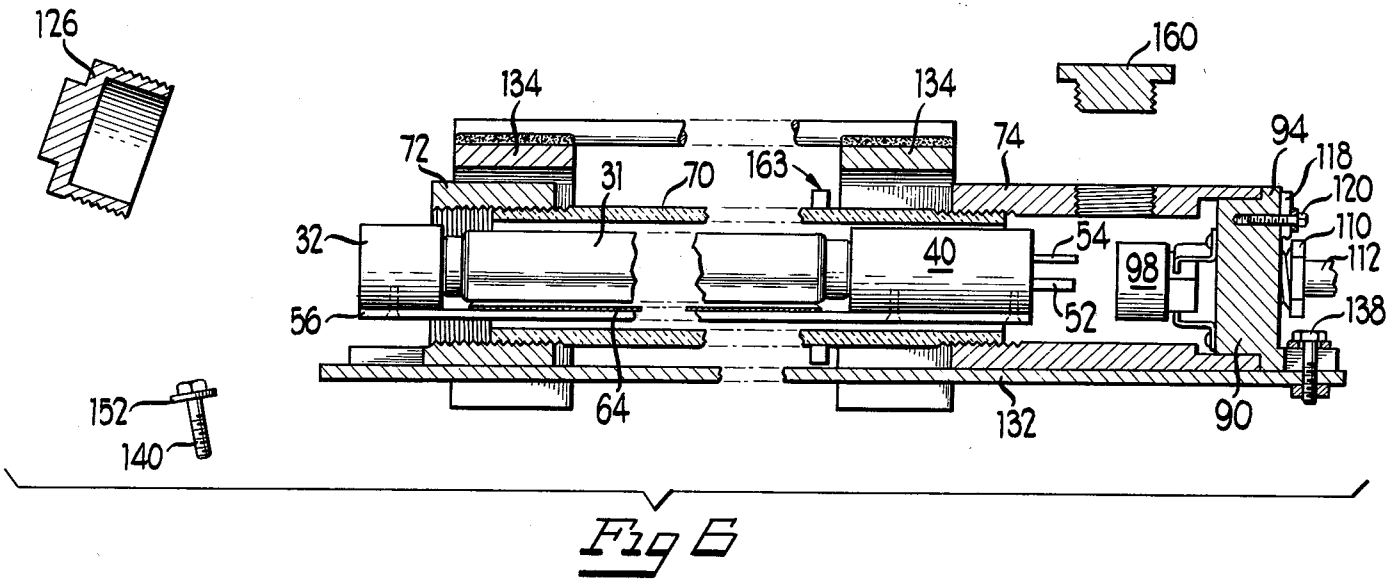
FIG. 6 is a view similar to FIG. 5 showing an initial step in removing the entire lighting assembly as a unit.
Figure 7:
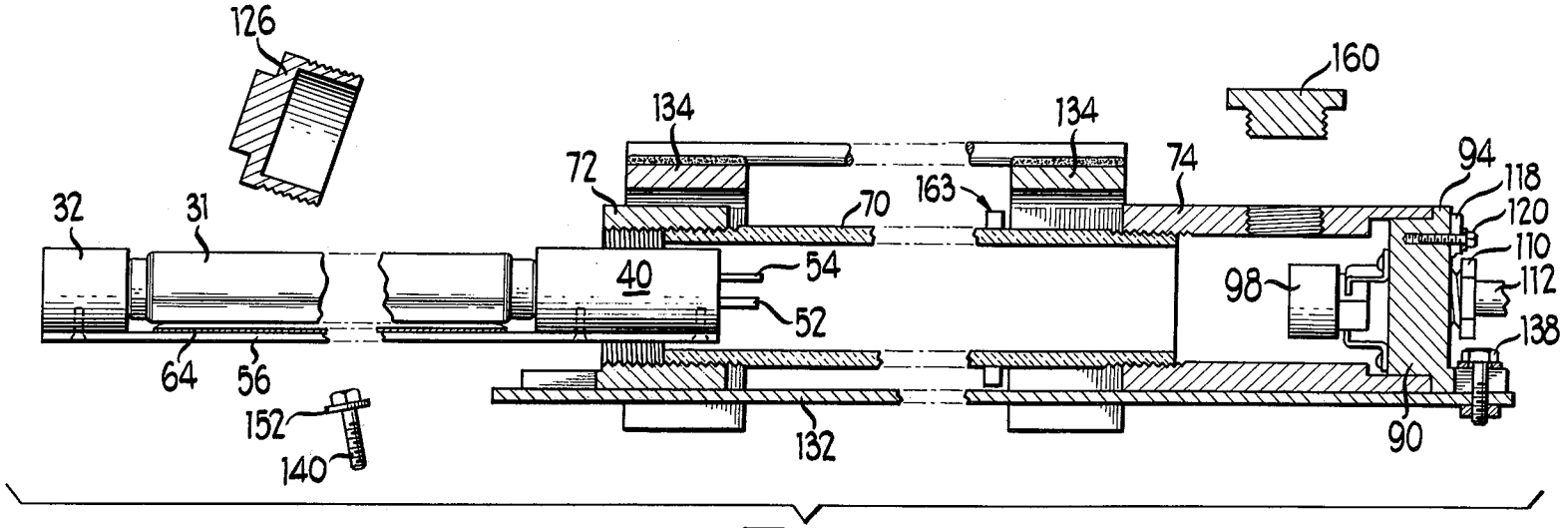
FIG. 7 is a view similar to FIG. 6 showing a final step in removing the lighting assembly.

An important part of the invention is that the lighting assembly 26 is removable and replaceable as a unit, for quick, reliable repair at the working site. The repair crew does not have to waste time determining whether a dead lamp is caused by a bad bulb, or a faulty starter or ballast. Replacement is carried out as follows: Bolt 140 is removed to clear the locking tab 148 from interference with the cover 126. The inspection cover is unscrewed from the end housing 72 and the lighting assembly is first moved sufficiently to disconnect the plug 46 from the socket 98 as shown in FIG. 6. Next, the entire lighting assembly 26 is pulled through the end opening 78. A new lighting assembly will then be inserted with its plug 46 connected to the socket 98 and the parts reassembled for use as shown in FIGS. 4 and 5. Alternatively, the cap screws 86 and mounting bolt 140 may be removed to enable the inner guard assembly (except cover section 84) to be slid out of the outer guard assembly, exposing the lighting assembly for replacement as a unit.

To facilitate removal of the plug 46 from the socket 98, a side access opening 158 is provided in one side wall of the ballast housing 74. A threaded plug 160 is screwed-connected into it, and held against inadvertent loosening by a small rectangular tab 162 fastened by set screw 164 and bearing against one of the flats of the hexagonal head. Access opening 158 is located relative to the socket 98 to enable a repair man to insert a tool such as a screw driver to help pry the plug 46 loose from the contacts in the socket 98.

Mining environments for which this lamp has been designed are, of course, relatively dusty. Coal and rock dust are in the air most of the time. These constantly settle out and would eventually reduce the available illumination below the required standards without some provision for keeping the lamp clean. This is provided in the present case by a cleaner ring 163 having a rubber-like or leather annular wiper element 166 engaging the outer cylindrical surface 168 of the transparent cylindrical bulb housing 70. Referring FIG. 5, the cleaner ring 163 may be grasped and moved in one sweep from the solid line position shown at the right to the broken line position shown at the left thereby cleaning the entire surface of the transparent bulb housing in one movement.

The lamp versions illustrated in FIGS. 1, 2 and 3, as described above, are identical except where individual parts are required to be made longer to accomodate longer fluorescent bulbs. The housings 72 and 74 and associated components may be identical. The hoops 134 may be identical, with different numbers being required. Rods **136, 136*a* and 136*b* are similar, differing only in length. And the same may be said of the transparent bulb housings 70, 70*b* and 70*c*, and support plates 132, 132*a* and 132*b*. By way of examples, the lamp of FIG. 1 may use an 8 watt fluorescent bulb; the lamp of FIG. 2 may use a 15 or 20 watt bulb; and the lamp of FIG. 3** may use a 30 or 40 watt bulb.

By providing the lamp with both inner and outer guard assemblies as shown they are able to withstand very severe service. By providing the unitary lighting assembly and ready access thereto by means of the inspection cover 126 and socket access cover 160, repair can be made with a minimum of down time. And the cleaner ring makes it possible to maintain peak light transmission with minimum maintenance effort.

The above described embodiment of the invention, illustrated in three sizes, show a small number of possible variations of the invention. Numerous and varied other arrangements can readily be devised in accordance with the principles herein disclosed, without departing from the spirit or scope of the invention.

The embodiments of the invention in which an exclusive property or privilege is claimed are defined as follows:

1. A lamp permissible for use in explosive atmospheres such as mines comprising:

a lighting assembly and inner and outer guard assemblies therefor;

said lighting assembly including an elongated bulb with starter and ballast members removably connected to opposite ends thereof, and grounding means interconnecting said starter and ballast members;

said inner guard assembly including a transparent cylindrical housing enclosing said bulb, and end housings at the ends of said cylindrical housing enclosing said starter and ballast members respectively, electrical power outlet means in one of said end housings electrically connected to said starter and ballast members, electrical power conductors extending through a wall of said one end housing and means in said wall for sealing said conductors; and said outer guard assembly including an elongated support plate, means for mounting said end housings on opposite ends of said support plate, a plurality of hoops fastened to said support plate at spaced intervals therealong, and a plurality of rods fastened to said hoops extending parallel to and exteriorly of said bulb housing and providing cage-like protection therefor.

2. A lamp according to claim 1 with a cleaner ring having an annular wiper element engaging the outer surface of said transparent cylindrical housing, said cleaner ring being slidable along said outer surface to remove soil in a single end to end sweep.

3. A lamp according to claim 1 in which said grounding means comprises a rigid bar parallel to said bulb and mechanically connected to said starter and ballast members to make them an integral part of the lighting assembly for ready removal and replacement as a unit.

4. A lamp according to claim 3 having an elongated reflector supported on said bar along said bulb.

5. A lamp according to claim 1 having said lighting assembly electrically connected to said electrical power outlet means through a plug within said one end housing, and an access opening in the opposite end housing in alignment with said lighting assembly enabling said lighting assembly to be inserted into or removed from said inner guard assembly as a unit through said access opening, and a closure for said access opening.

6. A lamp according to claim 5 having a side access opening in a side wall of said one end housing providing access to said electrical power outlet means to facilitate electrical connections and disconnections between said power outlet means and said plug of said lighting assembly, and a closure for said side access opening.

7. A lamp according to claim 1 in which said one end housing of said inner guard assembly consists of a body section and a cover section removably attached thereto, said body section being attached to said transparent cylindrical housing, said wall of said one end housing through which said electrical power conductors extend being a part of that removable cover section, said electrical power outlet means in said one end housing being a socket mounted on said cover section, said ballast member having an integral plug portion removably connectible to said socket, whereby the inner guard assembly can be detached from said cover section and removed from said outer guard assembly to expose the lighting assembly for replacement as a unit.

8. A lamp according to claim 7 in which each of said starter and ballast members includes as a unitary part thereof socket means for pin means at the corresponding end of the bulb.

* * * * *

UNITED STATES PATENT OFFICE

CERTIFICATE OF CORRECTION

PATENT NO. : 4,042,819

DATED : August 16, 1977

INVENTOR(S) : Perfecto Dacal

It is certified that error appears in the above-identified patent and that said Letters Patent are hereby corrected as shown below:

Col. 2, line 35: "place" should be --plate--

Col. 5, line 42: "botl" should be --bolt--

Col. 6, line 38: insert --to-- between "referring" and "Fig."

Signed and Sealed this

*Twenty-fourth* Day of *January 1978*

[SEAL]

*Attest:*

RUTH C. MASON
*Attesting Officer*

LUTRELLE F. PARKER
*Acting Commissioner of Patents and Trademarks*